US007625239B1

(12) United States Patent
Jatou et al.

(10) Patent No.: US 7,625,239 B1
(45) Date of Patent: Dec. 1, 2009

(54) SINGLE-TO-MULTIPLE DISPLAY ADAPTER UTILIZING A SINGLE CABLE CONSTRUCTION

(75) Inventors: Ross F. Jatou, San Jose, CA (US); Diaco Davari, San Jose, CA (US); Nandan Subraman, Milpitas, CA (US)

(73) Assignee: NVIDIA Corporation, Santa Clara, CA (US)

( * ) Notice: Subject to any disclaimer, the term of this patent is extended or adjusted under 35 U.S.C. 154(b) by 235 days.

(21) Appl. No.: 11/948,979

(22) Filed: Nov. 30, 2007

(51) Int. Cl.
*H01R 9/11* (2006.01)

(52) U.S. Cl. ..... 439/623

(58) Field of Classification Search ..... 439/623, 439/502, 76.1; 725/119, 109
See application file for complete search history.

(56) References Cited

U.S. PATENT DOCUMENTS 6,169,879 B1 * 1/2001 Perlman ..... 725/119
7,200,856 B2 * 4/2007 Perlman ..... 725/82
7,488,187 B2 * 2/2009 Wolf ..... 439/106
2006/0288388 A1 * 12/2006 Harris et al. ..... 725/81
2009/0061678 A1 * 3/2009 Minoo et al. ..... 439/502
2009/0109336 A1 * 4/2009 Watanabe et al. ..... 348/558

OTHER PUBLICATIONS

Prior Art Adapter Designs, Jan. 29, 2003.

* cited by examiner

*Primary Examiner*—Neil Abrams
*Assistant Examiner*—Phuong Nguyen
(74) *Attorney, Agent, or Firm*—Patterson & Sheridan, LLP

(57) ABSTRACT

One embodiment of the present invention sets forth a cable assembly for separating video signals within a high-density connector to individual video connectors. The cable assembly includes a high-density connector, a cable to transmit multiple video signals, and a printed circuit board (PCB) assembly configured to separate the video signals into individual video signals. The individual video signals are routed under controlled impedance conditions provided by the PCB to individual video connectors attached to the PCB.

20 Claims, 5 Drawing Sheets

SINGLE-TO-MULTIPLE DISPLAY ADAPTER UTILIZING A SINGLE CABLE CONSTRUCTION

BACKGROUND OF THE INVENTION

1. Field of the Invention

Embodiments of the present invention relate generally to graphics system hardware and more specifically to a single-to-multiple display adapter utilizing a single cable construction.

2. Description of the Related Art

A typical computer system includes, without limitation, a central processing unit (CPU), a graphics processing unit (GPU), at least one display device, and one or more input devices, such as a keyboard and a mouse. In many common applications, users require two or more display devices to be attached to a single computer system. The display devices are typically attached to the computer system via video cables that connect to one or more graphics adapter cards, installed within the computer system.

To maximize connector area efficiency, a host adapter card may incorporate a high-density connector to transmit two or more standard video signals. The two or more video signals available through the high-density connector need to be separated out into individual standard video connectors in order to properly connect to associated display devices. A cable assembly is typically used to attach two or more display devices to the high-density connector. The cable assembly commonly includes a matching high-density connector and two or more independent cables emerging from the matching high-density connector in a structure known as a "pig-tail." The loose end of each independent cable is attached to a standard video connector that is configured to deliver a video signal to a single-channel video cable. The single-channel video cable includes a sufficient number of conductive paths to deliver a standard video signal to from a first standard video connector to a second standard video connector, which may be attached to a display device.

The pig-tail cabling structure facilitates the use of high-density connectors, while preserving compatibility with existing single-channel cabling regimes. However, the pig-tail cabling structure is also quite bulky at the exit point of the matching high-density connector and adds an additional cable end connector in the video signal path. Each signal within the cable end connector typically traverses an ungrounded span from the shielded cable to a predefined pin on the connector. This ungrounded span degrades the overall signal integrity of the video signal by interposing an impedance mismatched span in the signal path. Each impedance mismatched span in the signal path introduces noise in the transmitted signal, reducing overall system performance.

One approach to minimizing signal degradation in a pig tail cabling structure is to use high quality, low-loss components and cables. For example, high-quality low-loss cables may be used along with cable end connectors designed to match impedance and minimize connector injection loss. While this approach may help, significant signal degradation nonetheless occurs in the ungrounded span from the cable end to the connector pins. This signal degradation is becoming an important limiting factor in video cable assembly performance as general advances in video technology drive video signals to higher speeds, making the signals more susceptible to impedance mismatches.

As the foregoing illustrates, what is needed in the art is a mechanism for separating video signals from a high-density connector to individual standard connectors that also minimizes impedance mismatching effects.

SUMMARY OF THE INVENTION

One embodiment of the present invention sets forth a cable assembly for separating video signals within a high-density connector to individual video connectors. The cable assembly includes a high-density connector, a cable to transmit multiple video signals, and a printed circuit board (PCB) assembly configured to separate the video signals into individual video signals. The individual video signals are advantageously routed under controlled impedance conditions provided by the PCB to individual video connectors attached to the PCB.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
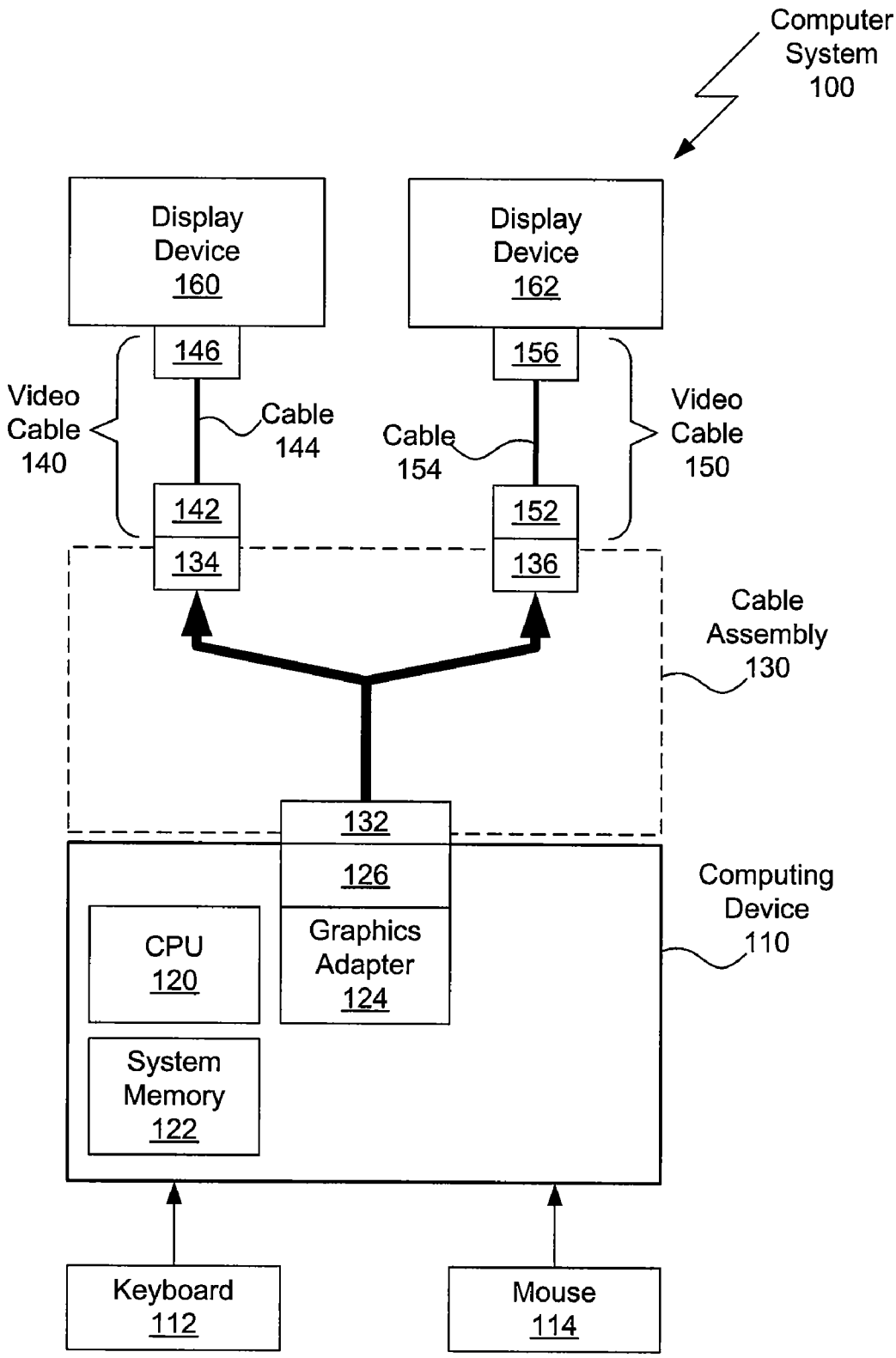
FIG. 1 depicts a computer system in which one or more aspects of the invention may be implemented.

FIG. 1 depicts a computer system 100 in which one or more aspects of the invention may be implemented. The computer system 100 includes, without limitation, a computing device 110, a keyboard 112, a mouse 114, a cable assembly 130, single-channel cables 140, 150, and display devices 160, 162.

The computer system 110 includes, without limitation, a central processing unit (CPU) 120, a system memory 122, and a graphics adapter 124, which incorporates a high-density connector 126. The CPU 120 processes instructions and data stored in the system memory 122 and receives user input from the keyboard 112 and the mouse 114. Additionally, the CPU 120 generates graphics images, either independently or with the assistance of the graphics adapter 124, for display on the display devices 160, 162. The graphics adapter 124 processes the graphics images into two or more video signals that are transmitted through the high-density connector 126 as electrical signals.

A matching high-density connector 132 within the cable assembly 130 receives the two or more video signals. The two or more video signals are separated into two or more independent video signals within the cable assembly 130 and transmitted to independent standard video connectors 134, 136. Each standard video connector 134, 136 may be connected to a corresponding video cable 140, 150, such as a single-channel video cable, configured to transmit video signals to one or more corresponding display devices 160, 162.

Each video cable 140, 150, includes a matching standard video connector 142, 152, a display-side standard video connector 146, 156, and a cable 144, 154. Cable 144 is configured to transmit video signals from matching standard video connector 142 to display-side standard video connector 146. Similarly, cable 154 is configured to transmit video signals from matching standard connector 152 to display-side standard video connector 156.

Display device 160 is configured to receive video signals from the display-side standard video connector 146 of video cable 140. Display device 160 generates visible images for viewing from the video signals. Similarly, display device 162 is configured to receive video signals from the display-side standard video connector 156 of video cable 150 and to generate visible images for viewing from the video signals.

Figure 2:
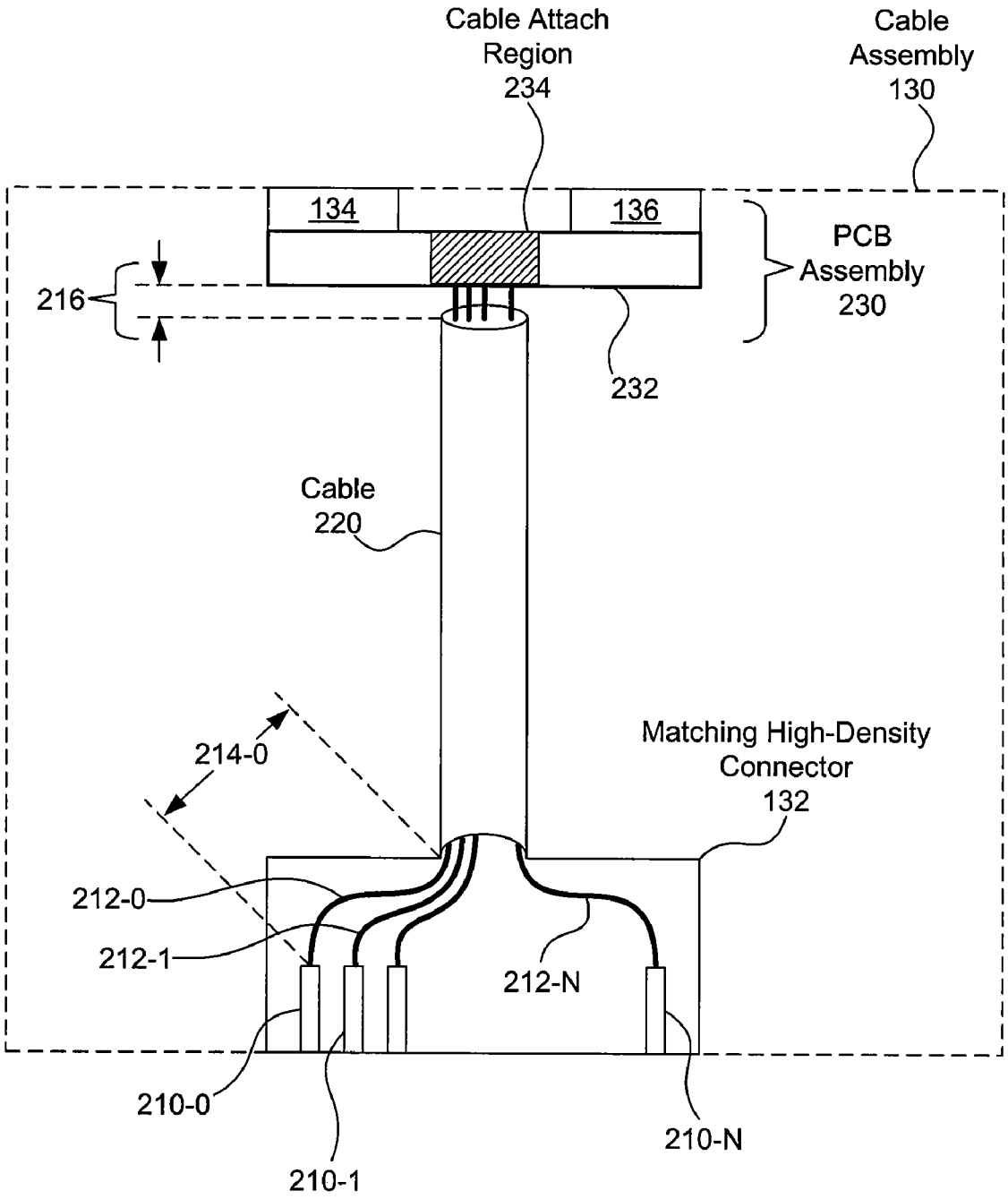
FIG. 2 illustrates the cable assembly for interfacing the matching high-density connector to two standard video connectors, according to one embodiment of the invention.

FIG. 2 illustrates the cable assembly 130 for interfacing matching the high-density connector 132 to two standard video connectors 134, 136, according to one embodiment of the invention. The cable assembly 130 of FIG. 1 includes the matching high-density connector 132, a single cable 220, and a printed circuit board (PCB) assembly 230.

The matching high-density connector 132 includes a set of electrically conductive pins 210, which are connected to wires 212 from cable 220. The cable 220 includes a set of wires 212 and should provide a controlled impedance environment for signals traveling along the wires 212. Each wire 212 spans a certain distance 214 from the cable 220 to the respective pin 210. The distance 214 represents an ungrounded span. As illustrated in greater detail in FIG. 3, the electrical impedance of a given wire 212 transitions from the impedance controlled environment of the cable 220 to approximately the impedance of a freely suspended conductor, and then back to a relatively well controlled environment within the cluster of pins 210. The length of each ungrounded span is a function of which wire 212 is connected to which pin 210. Pins 210 situated further from the cable 220 will tend to have larger ungrounded spans and therefore impart more noise on the associated signal.

The PCB assembly 230 includes a PCB 232, standard video connectors 134, 136, and a cable attach region 234 on the PCB 232. In one embodiment, the cable attach region 234 includes a field of through-holes where wires 212 from the cable 220 may be inserted and soldered to the PCB 232. Distance 216 represents the ungrounded span a wire may take from the cable 220 to the surface of the PCB 232 within the cable attach region 234. Because the field of through-holes may be more tightly packed around the cross section of the cable 220, distance 216 should be significantly smaller than the distance 214 associated with separating wires out to reach pins 210 within the matching high-density connector 132. Thus, noise introduced within the ungrounded span associated with distance 216 should be significantly less than noise introduced within the longer ungrounded span associated with distance 214.

Figure 3:
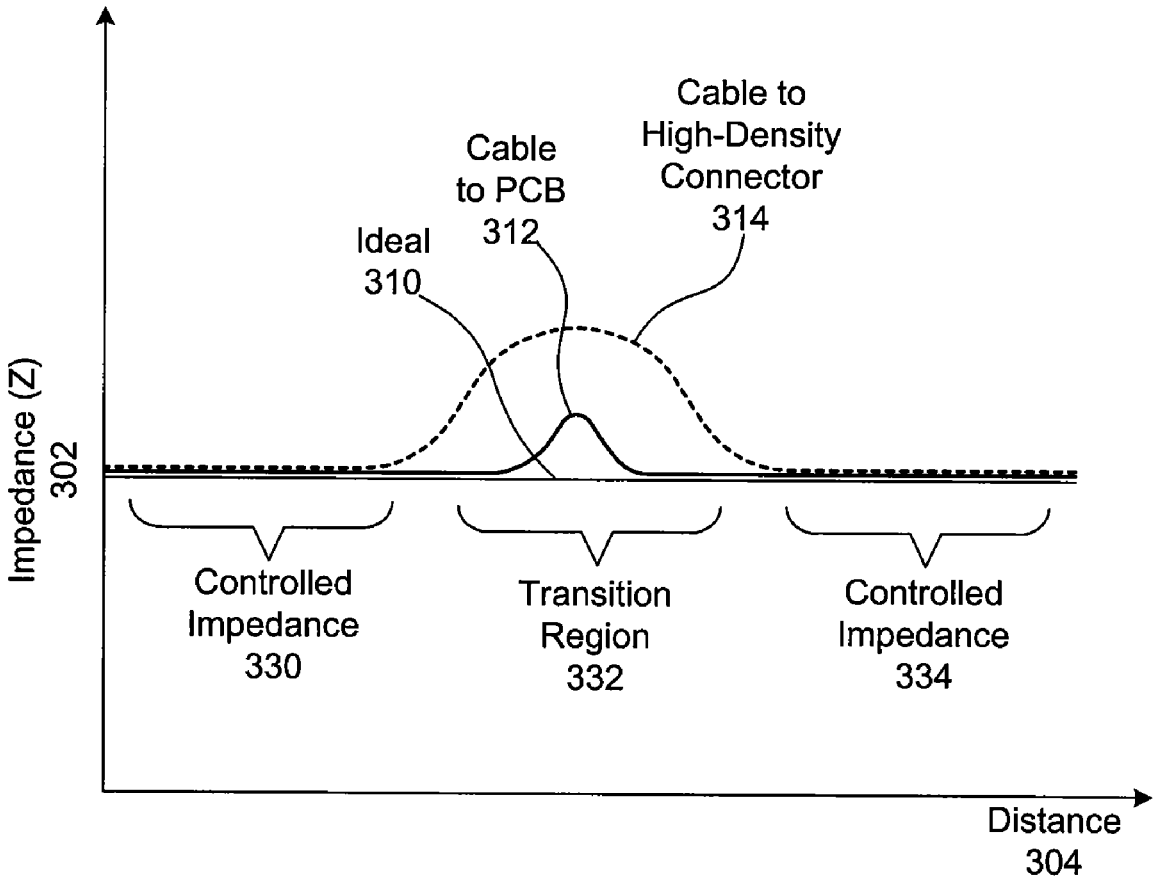
FIG. 3 illustrates signal path impedance as a function of distance for three scenarios.

FIG. 3 illustrates signal path impedance 302 as a function of distance 304 for three scenarios 310, 312, 314. Three regions along a signal path are represented as two controlled impedance regions 330, 334, and one transition region 332. For example, the first controlled impedance region 330 may correspond to signals traveling along wires 212 within cable 220 of FIG. 2. Additionally, the transition region 332 may correspond to the ungrounded span each wire 212 traverses from cable 220 to a pin 210 or the PCB 232. Furthermore, the second controlled impedance region 334 may correspond to a path within the PCB 232 or within matching high-density connector 132.

In an ideal scenario 310, the signal path impedance 302 does not change as a signal traverses from the first controlled impedance region 330 to the transition region 332 to the second controlled impedance region 334. In the cable to high-density connector scenario 314, the signal path impedance 302 may increase significantly for longer wire spans within the high-density connector. In the cable to PCB scenario 312, the ungrounded span is negligible or very small and the path impedance 302 does not change dramatically. Furthermore, any path impedance variation associated with this scenario is limited to a relatively short distance. In a high-quality implementation, the cable to PCB scenario 312 should represent a path impedance 302 characteristics close to the ideal scenario 310 and introduce negligible noise, if any, within the video signal path.

Figure 4:
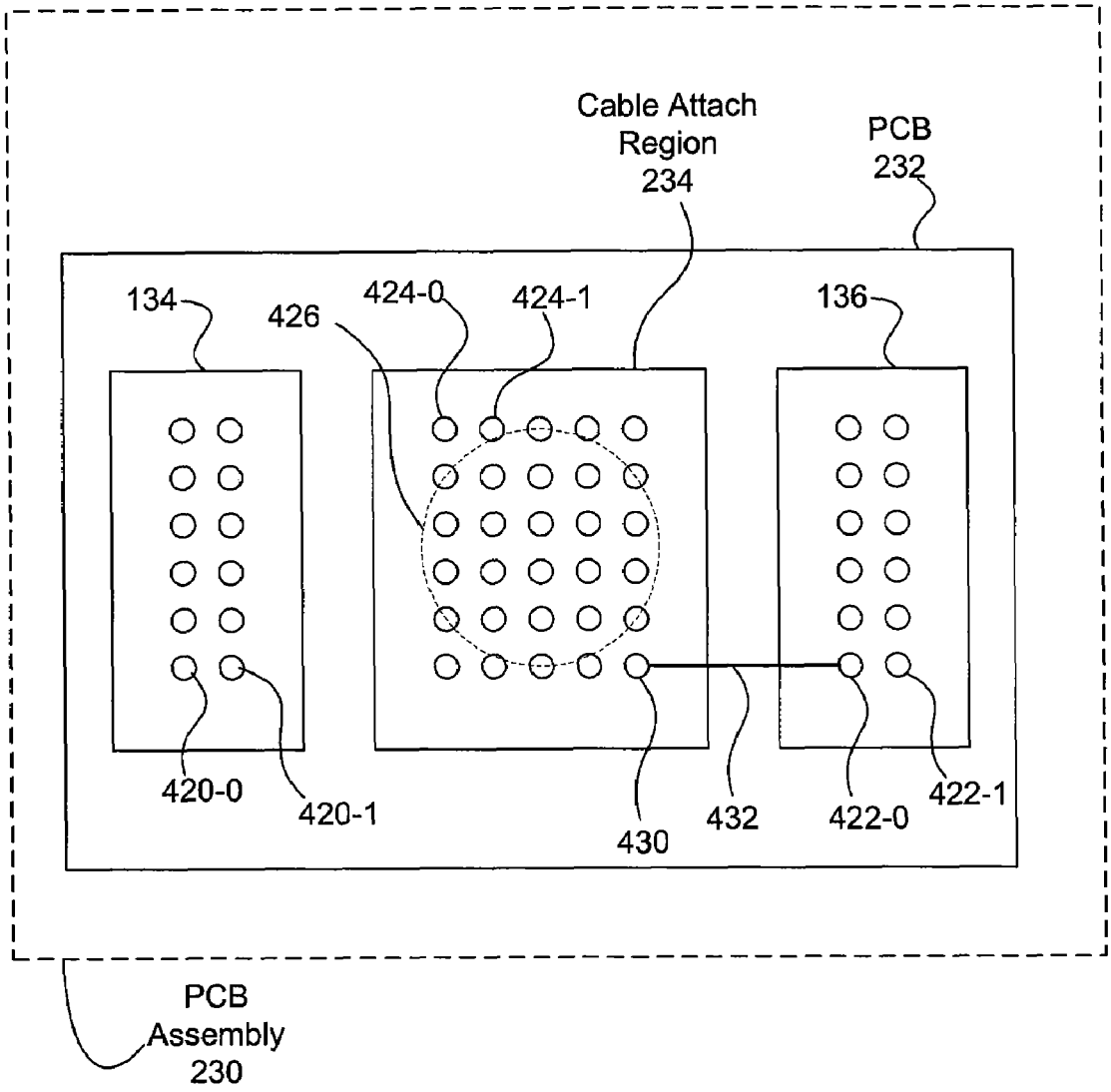
FIG. 4 depicts the printed circuit board assembly used for direct attachment to a cable carrying multiple video signals, according to one embodiment of the invention.

FIG. 4 depicts the printed circuit board assembly 230 used for direct attachment to a cable carrying multiple video signals, according to one embodiment of the invention. The PCB assembly 230 includes, PCB 232, standard video connectors 134 and 136, cable attach region 234, PCB connection sites 420, 422 and 424, and at least one PCB trace 432.

The cable attach region 234 includes a field of connection sites 424 situated close to a cable cross section 426, which corresponds to the cross sectional area of cable 220 of FIG. 2. Wires 212 from cable 220 may be electrically attached to the PCB 232 using connection sites 424, within the cable attach region 234. In one embodiment, the connection sites 424 are through-holes in the PCB 232.

Standard video connector 134 may be electrically attached to the PCB 232 using connection sites 420. Similarly, standard video connector 136 may be electrically attached to the PCB 232 using connection sites 422. In one embodiment, the connection sites 420, 422 are through-holes in the PCB 232.

PCB trace 432 electrically connects at least one connection site 424 within the cable attach region 234 to at least one connection site 422 associated with the standard video connector 136. PCB trace 432 should be a controlled impedance trace to preserve signal integrity for the length of the trace. For example, a 50-Ohm controlled impedance trace should be used for applications requiring a 50-Ohm to ground impedance. Two 50-Ohm traces, routed to matching lengths, may be used where 100-Ohm differential impedance is required. In practical embodiments, a plurality of PCB traces connects a plurality of connection sites 424 to connection sites 422 and 420.

Figure 5:
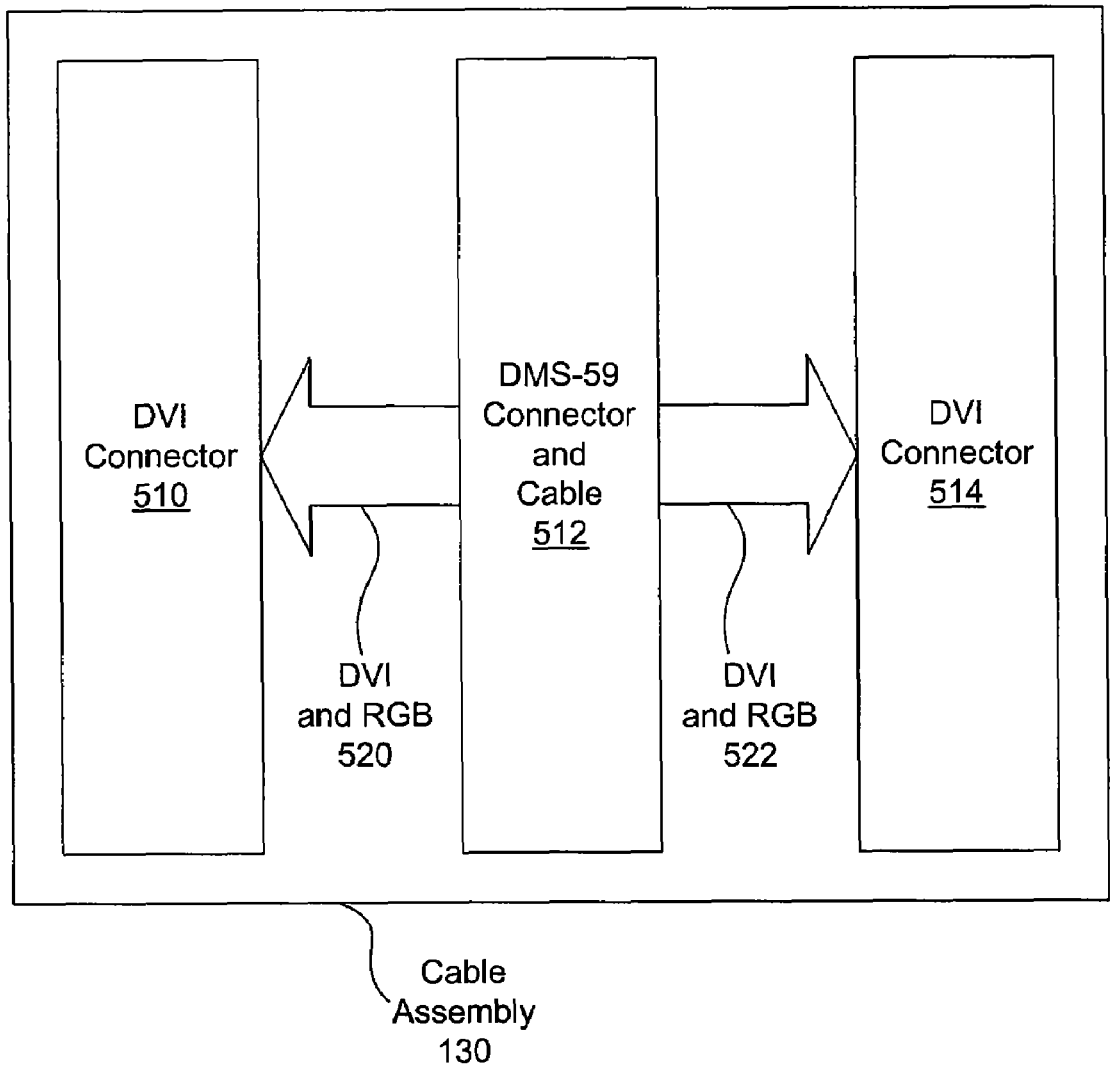
FIG. 5 depicts a specific cable assembly implementation, whereby two digital video interface (DVI) connectors are attached to a DMS-59 connector and cable, according to one embodiment of the invention.

FIG. 5 depicts a specific cable assembly implementation, whereby two digital video interface (DVI) connectors 510 and 514 are attached to an industry standard DMS-59 connector and cable 512, according to one embodiment of the invention. In this embodiment, the cable assembly 130, of FIG. 1, includes two DVI connectors 510 and 514 and a DMS-59 connector and cable, constructed according to the teachings set forth in FIGS. 2 and 4. The DMS-59 connector and cable 512 correspond to the matching high-density connector 132 and cable 220 shown in FIG. 2. A set of PCB traces, such as PCB trace 432, is used to transmit DVI and RGB signals 520 from the DMS-59 connector and cable 512 to the first DVI connector 510. Similarly, PCB traces are used to transmit DVI and RGB signals 522 from the DMS-59 connector and cable 512 to the first DVI connector 514.

In sum, superior signal quality may be achieved by coupling wires directly from a cable carrying multiple video signals to a PCB and by using PCB traces to transmit individual video signals to individual video connectors. In one embodiment, a cable assembly may be constructed for splitting two video signals transmitted through a standard DMS-59 connector to two independent DVI connectors. The DMS-59 connector attaches to a cable, which is directly attached to a PCB. The PCB contains DVI connectors and impedance controlled PCB traces for connecting the signals transmitted by the cable to two independent DVI connectors.

While the forgoing is directed to embodiments of the present invention, other and further embodiments of the invention may be devised without departing from the basic scope thereof. For example, aspects of the present invention may be implemented in hardware or software or in a combination of hardware and software. Therefore, the scope of the present invention is determined by the claims that follow.

We claim:

1. A video cable assembly for separating signals from a high-density connector to two or more standard video connectors, the video cable assembly comprising:

a matching high-density connector configured to receive signals from the high-density connector;

a cable configured to transmit signals from the matching high-density connector;

a printed circuit board configured to receive signals from the cable and to transmit the signals to the two or more standard video connectors connected to the printed circuit board.

2. The video cable assembly of claim 1, wherein the printed circuit board includes at least one cable connection through-hole for connecting wires from the cable.

3. The video cable assembly of claim 1, wherein the printed circuit board includes at least one controlled impedance trace for connecting at least one cable connection through-hole to at least one co-connector connection site.

4. The video cable assembly of claim 1, wherein the matching high-density connector is a DMS-59 connector.

5. The video cable assembly of claim 4, wherein the DMS-59 connector is a male connector.

6. The video cable assembly of claim 1, wherein at least one of the two or more standard video connectors is a digital video interface connector.

7. The video cable assembly of claim 6, wherein the digital video interface connector is a female connector.

8. The video cable assembly of claim 1, wherein the cable includes at least one controlled impedance wire.

9. The video cable assembly of claim 8, wherein the impedance of the at least one controlled impedance wire is about 50-Ohms.

10. The video cable assembly of claim 1, wherein the printed circuit board includes at least one connector connection site for connecting pins from at least one standard video connector to the circuit board.

11. The video cable assembly of claim 10, wherein the at least one connector connection site is a through-hole.

12. The video cable assembly of claim 1, wherein the at least one connector connection site is a surface-mount pad.

13. A system configured for separating signals from a high-density connector, the system comprising:

a computing device configured to generate at least two independent video signals;

at least two display devices, each configured to display one of the independent video signals;

at least two video cables, each configured to transmit one of the independent video signal to one of the display devices; and a video cable assembly that includes:

a matching high-density connector configured to receive the at least two independent video signals generated by the computing device from the high-density connector, a cable configured to transmit the at least two independent video signals from the matching high-density connector, and a printed circuit board configured to receive the at least two independent video signals from the cable and to transmit each of the at least two independent video signals to a different one of a plurality of standard video connectors connected to the printed circuit board.

14. The system of claim 13, wherein the matching high-density connector is a DMS-59 connector.

15. The system of claim 13, wherein at least one of the plurality of standard video connectors is a digital video interface connector.

16. The system of claim 13, wherein the printed circuit board includes at least one cable connection through-hole for connecting wires from the cable.

17. The system of claim 13, wherein the printed circuit board includes at least one connector connection site for connecting pins from at least one standard video connector to the circuit board.

18. The system of claim 13, wherein the printed circuit board includes at least one controlled impedance trace for connecting at least one cable connection through-hole to at least one co-connector connection site.

19. The system of claim 13, wherein the cable includes at least one controlled impedance wire.

20. The system of claim 19, wherein the impedance of the at least one controlled impedance wire is about 50-Ohms.

* * * * *